US006940048B2

(12) United States Patent
Wilkins

(10) Patent No.: US 6,940,048 B2
(45) Date of Patent: Sep. 6, 2005

(54) RADIANT ELECTRIC HEATER INCORPORATING A TEMPERATURE SENSOR ASSEMBLY

(75) Inventor: Peter Ravenscroft Wilkins, Droitwich (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 10/482,988

(22) PCT Filed: Jul. 8, 2002

(86) PCT No.: PCT/GB02/03152

§ 371 (c)(1),
(2), (4) Date: Jan. 7, 2004

(87) PCT Pub. No.: WO03/007660

PCT Pub. Date: Jan. 23, 2003

(65) Prior Publication Data

US 2004/0195232 A1 Oct. 7, 2004

(30) Foreign Application Priority Data

Jul. 11, 2001 (GB) ..... 0116884

(51) Int. Cl.[7] ..... H05B 3/68

(52) U.S. Cl. ..... 219/448.13; 219/451.1; 219/460.1; 219/448.18; 219/458.1; 219/494; 219/504; 219/462.1

(58) Field of Search ..... 219/448.13, 448.19, 219/448.18, 451.1, 452.11, 483, 458.1, 459.1, 460.1, 461.1, 462.1, 477–478, 481, 486, 494, 504–510

(56) References Cited

U.S. PATENT DOCUMENTS

| | | | | |
|---|---|---|---|---|
| 4,103,275 A | * | 7/1978 | Diehl et al. | 338/25 |
| 5,893,996 A | * | 4/1999 | Gross et al. | 219/447.1 |
| 6,039,040 A | | 3/2000 | Thumfart et al. | |

FOREIGN PATENT DOCUMENTS

| | | | |
|---|---|---|---|
| EP | 0943870 | | 9/1999 |
| EP | 943870 | * | 9/1999 |
| GB | 2192279 | | 1/1988 |
| WO | WO9516334 | | 7/1995 |

OTHER PUBLICATIONS

International Search Report May 21, 2003.

* cited by examiner

*Primary Examiner*—Shawntina Fuqua
(74) *Attorney, Agent, or Firm*—Ira S. Dorman

(57) ABSTRACT

A radiant electric heater (2) is arranged for location underneath and against a cooking plate (12) and incorporates a heating element (14) spaced from the cooking plate and a temperature sensor assembly (26). The temperature sensor assembly (26) comprises a beam (28) of ceramic material provided within the heater and extending at least partially across the heater over the at least one heating element (14). The beam (28) has a substantially planar upper surface (32) arranged to face the cooking plate (12), in contact with the cooking plate or in close proximity to it, and an under surface (34) arranged for exposure to direct radiation from the heating element (14). Provided on the planar upper surface (32) is an electrical component (36), such as of film or foil form, having an electrical parameter which changes as a function of temperature of the cooking plate.

36 Claims, 5 Drawing Sheets

FIG 2
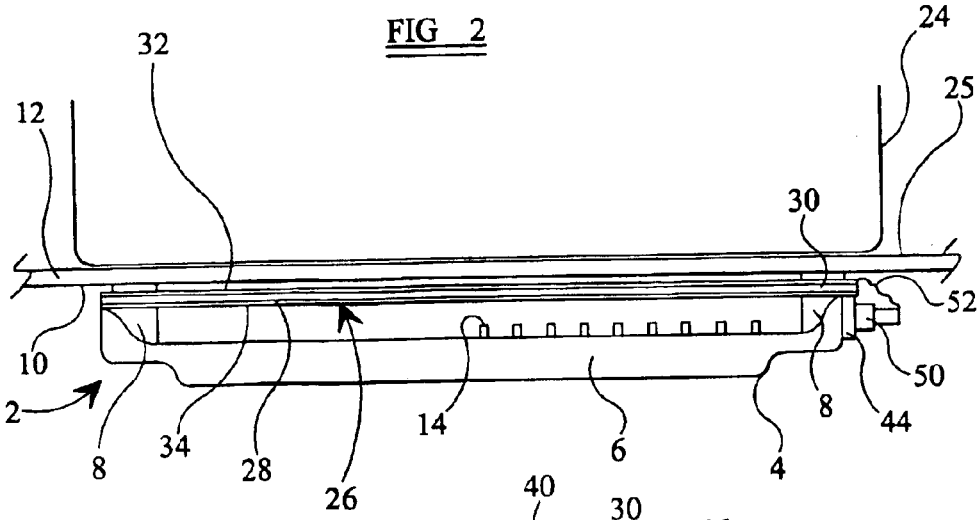
FIG 3
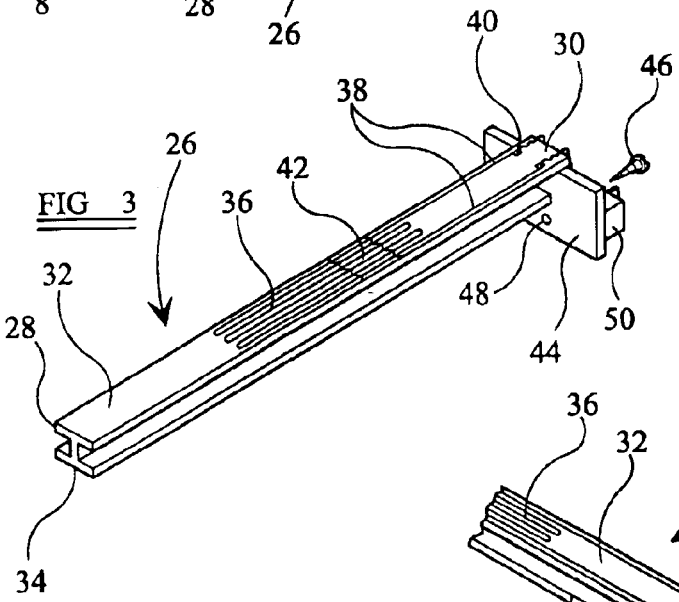
FIG 4
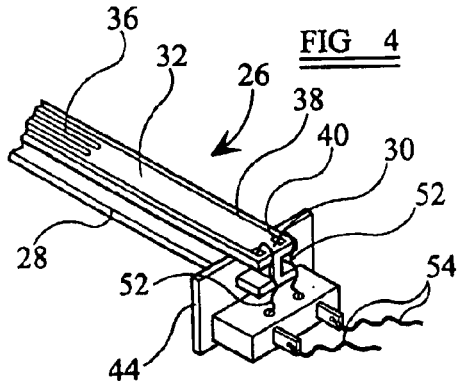
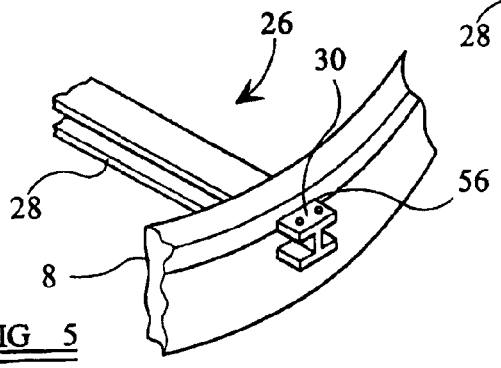
FIG 5

RADIANT ELECTRIC HEATER INCORPORATING A TEMPERATURE SENSOR ASSEMBLY

The present invention relates to a cooking apparatus incorporating a radiant electric heater and a temperature sensor assembly, the heater being arranged for location underneath a cooking plate, such as of glass-ceramic. More particularly, the present invention relates to such an apparatus in which a sensing element is provided having an electrical parameter which changes as a function of temperature.

BACKGROUND OF THE INVENTION

Radiant electric beaters are very well known, provided underneath and in contact with a cooking plate, particularly of glass-ceramic material, It is common practice to provide such heaters with thermal sensors of electromechanical or electronic form, the purpose of which is to limit maximum temperature of the upper surface of the cooking plate.

WO 95/16334 describes the use of a one- or two-dimensional thermoelectrical sensor based on radiation from a vitroceramic surface to control the temperature of the vitroceramic surface, the sensor possibly being shielded from direct radiation from the heating elements.

U.S. Pat. No. 4,103,275 describes a means for measuring resistance for a resistance thermometer consisting of an insulating former as a carrier and a thin platinum layer as resistance material, the carrier for the platinum layer being made of a material having a greater thermal coefficient of expansion than platinum over the range between 0 degrees Celsius and 1000 degrees Celsius.

In current technology, a temperature sensing probe is located in a space between a heating element and the underside of the cooking plate.

A disadvantage of such an arrangement is that the temperature attained by the sensing probe is significantly influenced by direct radiation from the heating element and does not accurately reflect the temperature of the upper surface of the cooking plate. The probe temperature can typically be 100 to 200 degrees Celsius higher than the corresponding temperature of the upper surface of the cooking plate, As a result, there are two temperature gradients between the sensing probe and the upper surface of the cooking plate, namely one temperature gradient between the sensing probe and the underside of the cooking plate and another temperature gradient between the underside of the cooking plate and its upper surface. These temperature gradients may vary as a result of, for example, changes in heater power density, heater temperature profile, and thermal loading by a selected cooking vessel located on the upper surface of the cooking plate. Such a cooking vessel affects the temperature of the upper surface of the cooking plate.

A temperature sensor used in such heaters is arranged to de-energise the heating element at a preset temperature value. Such preset temperature value is a compromise value to maintain acceptable maximum temperatures of the cooking plate under the requirements of abnormal load conditions (for example: no cooking vessel load; boil dry; offset cooking vessel on cooking plate; cooking vessel with a concave base, brought to a boil condition), while minimising the probability of de-energising the heating element under bring-to-boil conditions in respect of a load in the form of a cooking vessel located on the cooking plate. Repeated switching of the heating element under the latter conditions is undesirable, since the time to boil is increased.

When electronic temperature sensors are employed, the probability of such undesirable switching of the heating element occurring may be significantly reduced by incorporating an intelligent control profile within a dedicated 'fast boil' control setting. This necessitates use of intelligent, usually digital, microprocessor controllers, which are expensive.

The tolerance range of the preset temperature value of the temperature sensor is critical, as it compounds the aforementioned variables. Electromechanical temperature sensors yield a tolerance range of typically 50 to 60 degrees Celsius as a result of constraints imposed by materials, design and manufacturing technology. Currently available electronic temperature sensors exhibit much lower tolerance ranges, but these devices, together with their required control circuits, cost significantly more than electromechanical temperature sensor systems.

Furthermore, due to the aforementioned variables and temperature gradients, an electronic temperature sensor, as previously described, is only useful as a maximum temperature control device, such that it de-energises the heating element at a predetermined temperature value. Such an electronic temperature sensor is unable to support a control system that may control the temperature of the cooking plate in accordance with a required cooking duty cycle, involving 'closed loop' control temperature regulation, Current temperature regulation systems for cooking appliances having glass-ceramic cooking plates are 'open loop' in nature. Such temperature regulation systems cannot account for variations in cooking vessel material and geometry, cooking vessel mass, mass and thermal capacity of a food item in a cooking vessel, and most importantly, change in temperature gradient as the cooking vessel and contents heat up, accompanied by evaporation of water. Constant adjustment of the heater is required by a user, especially at low settings.

Furthermore, it is anticipated that the maximum operating temperatures for glass-ceramic cooking plates will be increased in the near future by as much as 40 degrees Celsius, as a result of materials and process development. The objective of this increased temperature is to provide opportunity for higher temperatures to be reached before switching of the heating element occurs, thereby reducing the probability of de-energising of the heater during a bring-to-boil cycle. Currently available temperature sensors may require further development in order to withstand the resulting higher maximum temperatures encountered during service, because of the constraints imposed by existing sensor element and enclosure materials. This could lead to increased cost of the sensor system.

BRIEF SUMMARY OF THE INVENTION

It is an object of the present invention to overcome or minimise one or more of the aforementioned problems.

According to the present invention there is provided a cooking apparatus comprising a radiant electric heater and electronic control apparatus, the heater being arranged for location underneath and against a cooking plate and incorporating a heating element spaced from the cooking plate and a temperature sensor assembly, wherein the temperature sensor assembly comprises a beam of ceramic material provided within the heater and extending at least partially across the heater over the heating element, the beam having a substantially planar upper surface arranged to face the cooking plate and an under surface arranged for exposure to direct radiation from the heating element, the planar upper surface having provided thereon an electrical component having an electrical parameter which changes as a function of temperature of the cooking plate, the electrical component being electrically connected by means of electrical leads to the electronic control apparatus, which electronic control apparatus receives input signals from the or each electrical component on the upper surface of the beam and also input signals from a manual control switch device, the input signals from the or each electrical component being processed by a fail-safe circuit having a fixed threshold temperature such that the or each heating element is arranged to be de-energised at a temperature above such fixed threshold.

The temperature sensor assembly may be located in a central region of the heater.

Alternatively, the temperature sensor assembly may be secured at least at one end region thereof to the heater at a periphery of the heater. At least one end region of the beam may extend outside the heater.

In such a case the beam may be secured, at one end region thereof, to the heater by means of a bracket which securely receives one end region of the beam and is fixed to an external region of the heater. The bracket may be of metal, ceramic or plastics.

Alternatively, the beam may be secured, at one end region thereof, to the heater by securely passing through an aperture in a peripheral wall of the heater. Such peripheral wall may comprise a substantially rigid material, such as bound vermiculite.

A terminal block may be provided at, or adjacent to, one end region of the beam.

The beam may be supported with spring biasing towards the cooking plate,

The input signals from the manual control switch device, and the input signals from the or each electrical component, may be processed by a signal processing circuit of analog or digital form, which is interfaced with a switch means for controlling energising of the or each heating element. The signal processing circuit may be arranged to compare sensed temperature with position of the manual control switch device and energise or de-energise the or each heating element, depending on whether the sensed temperature is respectively below or above that set by the manual control switch device.

When the signal processing circuit is a digital circuit, it may comprise a microprocessor interfaced with the or each electrical component by way of an analog to digital converter and interfaced with the manual control switch device by way of a digital output driver.

When the signal processing circuit is an analog circuit, it may comprise an analog signal processing integrated circuit which compares input signals from the manual control switch device with input signals from the or each electrical component and controls energising of the or each heating element in a manner proportional to the difference between the two input signals. Such control of energising of the or each heating element may be effected by way of an output signal tailored to specific control requirements of a solid state switch device which operates to control energising of the or each heating element.

Control of the or each heating element may be effected in closed loop manner.

The upper surface of the beam may be arranged to be in contact with or in close proximity to the cooking plate. The substantially planar upper surface of the beam may be arranged to face the cooking plate at a distance of substantially not more than 3.5 mm therefrom. The substantially planar upper surface of the beam may preferably be arranged to face the cooking plate at a distance of from 0.5 to 3.5 mm therefrom and more preferably at a distance of from 0.5 to 2.0 mm therefrom.

The electrical component having an electrical parameter which changes as a function of temperature may be of film or foil form. The electrical component of film or foil form may have electrical conductors of film or foil form extending therefrom to one end region of the beam which is adapted to be secured to the heater at the periphery thereof. The electrical component of film or foil form may comprise an electrical resistance component whose electrical resistance changes as a function of temperature. Such electrical resistance component may comprise platinum. The electrical component may be of thick film form.

A protective layer, such as of glass or ceramic, may be provided over the electrical component.

A layer of thermal radiation reflective material may be provided on the under surface of the beam.

The beam may be structurally reinforced, such as by having a T-shaped or H-shaped cross section.

The beam may comprise steatite, alumina or cordierite.

A plurality of heating zones, each with a heating element, may be provided substantially side-by-side in the heater, such as in concentric arrangement, a corresponding plurality of the electrical components being provided on the substantially planar upper surface of the beam, each of the electrical components being located in a corresponding heating zone, whereby temperature of the cooking plate in each heating zone is able to be monitored.

Difference in temperature between the plurality of heating zones may be determined by the electronic control apparatus in cooperation with the plurality of electrical components and used to determine placement and/or position of a cooking vessel on the cooking plate and/or size of a cooking vessel on the cooking plate and/or curvature of a base of a cooking vessel on the cooking plate.

The cooking apparatus of the present invention is advantageous in that the temperature-sensitive electrical component or components, for example of film or foil, on the upper surface of the beam is or are directed towards the cooking plate and not exposed to direct radiation from the heating element or elements. The beam shields the temperature-sensitive component or components from the heating element or elements.

The temperature sensor assembly is constructed such that it can be in proximity with the underside of the cooking plate, thereby ensuring that the temperature gradient between the temperature sensor assembly and the underside of the cooking plate is significantly reduced. A resulting increased distance between the heating element or elements and the temperature sensor assembly reduces the influence of direct radiation from the heating element or elements on the sensor assembly.

As a result of a lower temperature differential between the cooking plate and the temperature sensor assembly, such assembly can be made to be more reliable at the higher maximum temperatures of the cooking plate which are being introduced. Average maximum temperatures of 590 to 630 degrees Celsius are expected to be introduced for glass-ceramic cooking plates, compared with the present maximum temperatures of 550 to 590 degrees Celsius.

A further advantage resulting from the present invention is that a heater system may be set to provide a lower cooking plate temperature under free radiation conditions, without incurring unwanted switching of the heating element or elements during boiling cycles with a cooking vessel. Having lower cooking plate temperatures under free radiation conditions reduces heat loss under these conditions, thereby resulting in increased efficiency of a cooking appliance.

The improved thermal coupling between the temperature sensor assembly and the cooking plate allows the use of low-cost electronic control technology, avoiding the need for special high temperature excursion profiles applied through software-based algorithms programmed into microcontrollers.

Maximum temperature control can be provided through a single predetermined set point, allowing the use of a low-cost integrated circuit, embodying analog or digital technology, and combining temperature limiting and heater energy regulating functions.

There is also the potential to apply closed loop control of the cooking plate temperature by regulation of heater input energy. The cooking plate temperature can be applied as an input to the regulator control system, enabling more consistent and predictable power control to be achieved.

BRIEF DESCRIPTION OF THE SEVERAL VIEWS OF THE DRAWINGS

For a better understanding of the present invention and to show more clearly how it may be carried into effect, reference will now be made, by way of example, to the accompanying drawings in which:

FIG. 2 is a cross-sectional view of the heater of FIG. 1, beneath a cooking plate;

FIGS. 3 and 4 are perspective views from different angles of the temperature sensor assembly as provided in the heater of FIG. 1;

FIG. 5 is a detail showing an alternative mounting arrangement for the temperature sensor assembly in the heater of FIG. 1;

FIG. 10 is a schematic diagram of an embodiment of electronic control apparatus for use with the radiant electric heater forming part of the present invention.

DETAILED DESCRIPTION OF THE INVENTION

Figure 1:
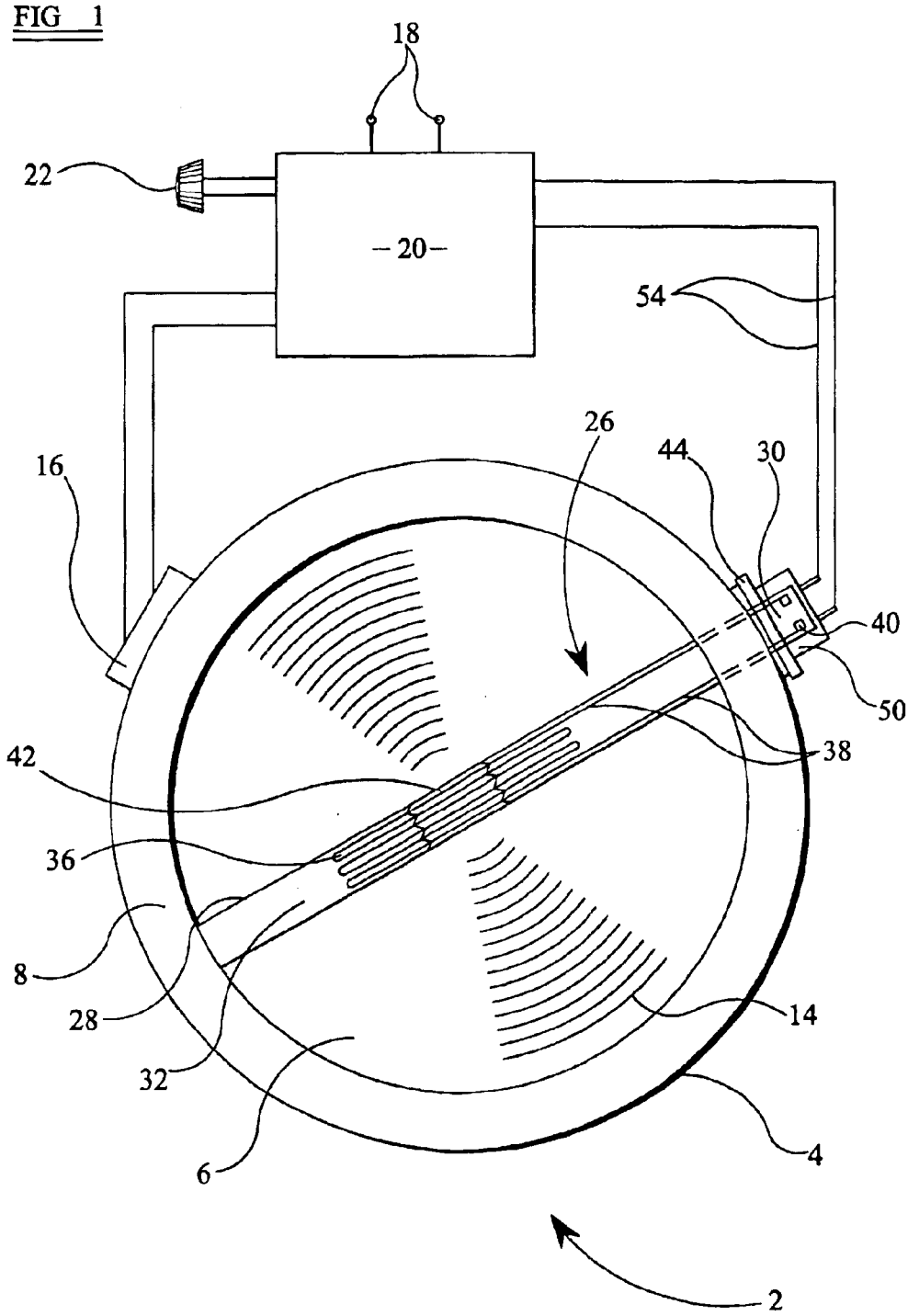
FIG. 1 is a plan view of one embodiment of a cooking apparatus according to the present invention including a radiant electric heater provided with an embodiment of a temperature sensor assembly and provided with electronic control apparatus shown in schematic form.
Figure 1:
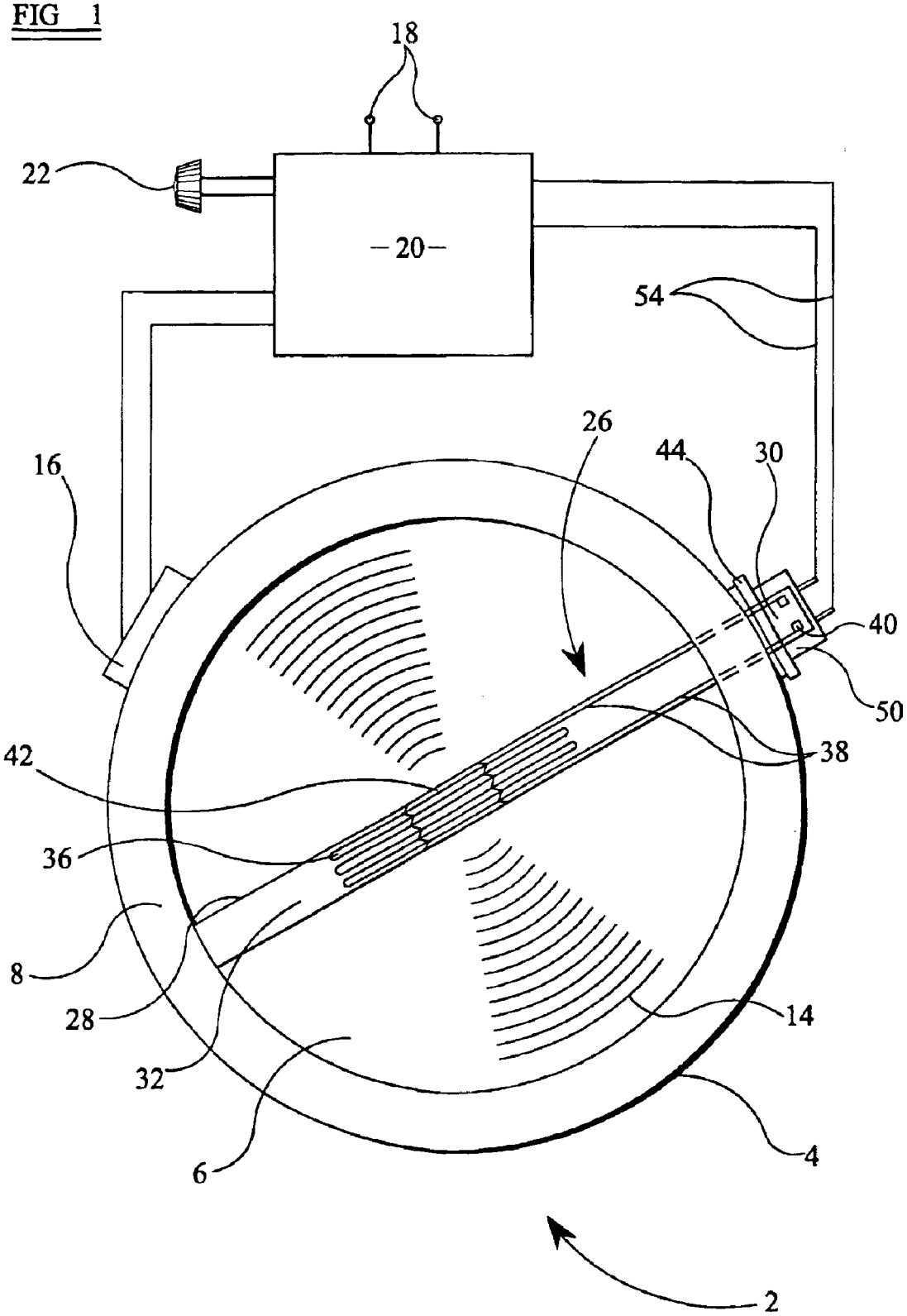

Referring to FIGS. 1 and 2, a radiant electric heater 2 comprises a metal dish-like support 4 having therein a base 6 of thermal and electrical insulation material, such as microporous thermal and electrical insulation material, and a peripheral wall 8 of thermal and electrical insulation material, such as bound vermiculite. The peripheral wall 8 is arranged to contact the underside 10 of a cooking plate 12, suitably of glass-ceramic material.

At least one radiant electric heating element 14 is supported in the heater relative to the base 6. The heating element or elements 14 can comprise any of the well-known forms of element, such as wire, ribbon, foil or lamp forms of element, or combinations thereof. In particular, the heating element or elements 14 can comprise one or more corrugated ribbon heating elements supported edgewise on the base 6.

The at least one heating element 14 is connected by way of a terminal block 16 at the edge of the heater to a power supply 18, through electronic control apparatus 20 provided with a manually operated control switch device 22. The control switch device 22 has a rotatable knob arranged to provide selected heating settings for the at least one heating element 14 in the heater 2.

The cooking plate 12 is arranged to receive a cooking vessel 24 on an upper surface 25 thereof.

A temperature sensor assembly 26, as shown in detail in FIGS. 3 and 4, is provided in the heater 2. The temperature sensor assembly 26 comprises a beam 28 of ceramic material supported at one end region 30 thereof at the periphery of the heater and extending at least partially across the heater over, and spaced from, the at least one heating element 14. The beam 28 has a substantially planar upper surface 32 arranged to face the underside 10 of the cooking plate 12, in contact therewith or in close proximity thereto. It is preferred that the upper surface 32 of the beam 28 should be spaced from the underside 10 of the cooking plate 12 by at least 0.5 mm, but by not more than about 3.5 mm and preferably by not more than about 2.0 mm.

The beam 28 suitably comprises steatite, alumina or cordierite ceramic material and is structurally reinforced to minimise risk of bending and/or fracture. Such structural reinforcement is suitably achieved by providing the beam 28 of H-shaped cross-section, as shown in FIG. 3, or of T-shaped cross-section, as shown in an embodiment in FIG. 7 to be described later.

The beam 28 has an under surface 34 arranged for exposure to direct radiation from the at least one heating element 14. The under surface 34 of the beam 28 may be provided with a layer of thermal radiation reflective material, such as silver, to minimise absorption, by the beam 28, of heat from the direct radiation of the at least one heating element 14.

The substantially planar upper surface 32 of the beam 26 has provided thereon at least one electrical component 36 of film or foil form having an electrical parameter which changes as a function of temperature of the cooking plate 12. The at least one electrical component 36 has electrical conductors 38, of film or foil form, extending therefrom to terminal lands 40 at the end region 30 of the beam 28.

The at least one electrical component 36 of film or foil form preferably comprises at least one electrical resistance component whose electrical resistance changes as a function of temperature. Such at least one electrical resistance component suitably comprises platinum.

The at least one electrical component 36 and the leads 38 are suitably of thick film form, provided by screen-printing and firing onto the upper surface 32 of the beam 28.

A protective layer 42, such as of glass or ceramic, may be provided over the at least one electrical component 36 of film or foil form.

The beam 28 is arranged to extend through an aperture in the peripheral wall 8 and rim of the dish-like support 4 of the heater 2 and such that the end region 30 of the beam 28 is located outside the heater 2.

The beam 28 is secured to the heater 2 by means of a bracket 44, suitably of metal, ceramic or plastics material, which is fixed to the end region 30 of the beam 28 and secured to the rim of the dish-like heater support 4 by a threaded fastener 46 passing through a hole 48 in the bracket 44. The beam 28 may have its end region 30 insert-moulded into the bracket 44, when the bracket 44 is of plastics material. When the bracket 44 is of ceramic material, it may be secured to the end region 30 of the beam 28 such that a dovetailed interconnection is formed therebetween.

A terminal block 50 is suitably secured to the bracket 44 and connected by lead wires 52 to the terminal lands 40 on the end region 30 of the beam 28. Since the end region 30 of the beam is located outside the heater, the lead wires 52 need not have a high-temperature-withstanding capability and may comprise a material such as copper.

When the bracket 44 comprises plastics or ceramic material, the terminal block 50 can be formed integral therewith.

The temperature sensor assembly 26 is electrically connected to the electronic control apparatus 20 by electrical leads 54.

As shown in FIG. 5, instead of a bracket 44 being provided to secure the beam 28 at the end region 30 thereof to the heater 2, the beam 28 has its end region 30 secured in an aperture 56 of complementary shape, provided in the peripheral wall 8 of the heater. Such peripheral wall 8, particularly of rigid bound vermiculite, can be arranged to provide satisfactory securing of the beam to the heater 2.

Figure 6:
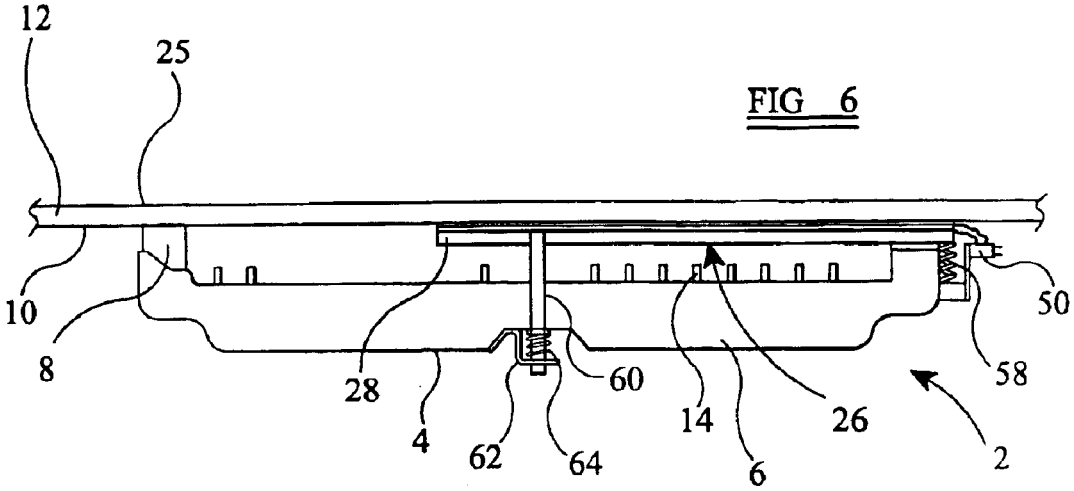
FIG. 6 is a cross-sectional view of a further embodiment of a radiant electric heater forming part of the present invention and incorporating a temperature sensor assembly.
Figure 7:
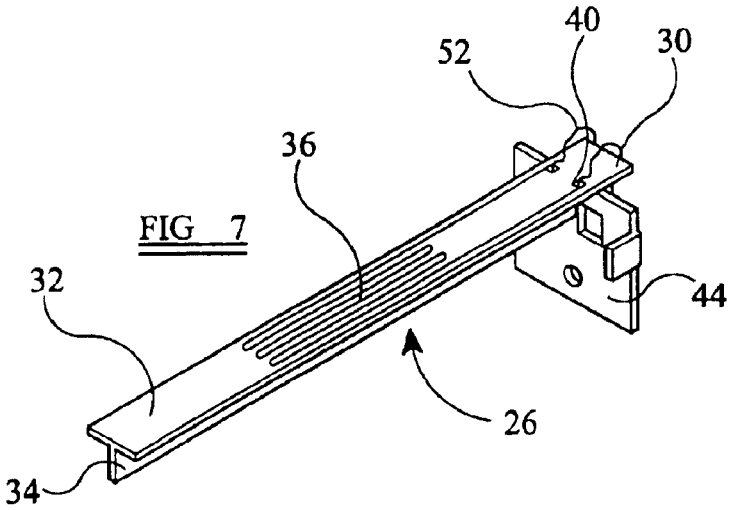
FIGS. 7 and 8 are perspective views from different angles of the temperature sensor assembly as provided in the heater of FIG. 6.
Figure 8:
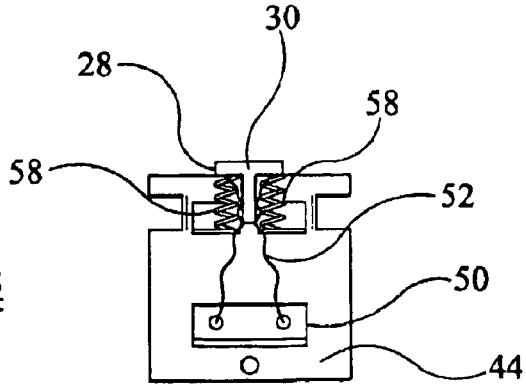

FIGS. 6, 7 and 8 illustrate an alternative embodiment which is substantially similar to that of FIGS. 1 to 4, with the main exception that the beam 28, which is here provided of T-shaped cross-section, is spring-loaded against the underside 10 of the cooking plate 12. Such spring-loading allows contact between the upper surface 32 of the beam 28 and the underside 10 of the cooking plate 12, while minimising risk of mechanical damage to the cooking plate 12 and/or the temperature sensor assembly 26, when subjected to mechanical shock load conditions.

The spring loading is achieved by incorporating one or more coil springs 58 cooperating between the end supporting bracket 44, which is suitably of metal, such as nickel-plated steel, and the underside of the end region 30 of the beam 28. A strut 60 is also provided at a central region of the heater 2, the strut 60 extending downwardly from the beam 28, through an aperture provided in the base 6 and the metal dish-like support 4, and into an aperture provided in a metal bracket 62 secured to the dish-like support 4. A coil spring 64 is arranged to co-operate between the strut 60 and the metal bracket 62.

The radiant electric heater 2 constructed according to the present invention is advantageous in that the temperature sensor assembly 26 is thermally closely-coupled to the cooking plate 12, thereby ensuring that any temperature gradient between the assembly and the underside 10 of the cooking plate 12 is minimised. The at least one temperature-responsive electrical component 36 of film or foil form on the upper surface 32 of the beam 28 is or are screened from the direct radiation from the at least one heating element 14 by the thickness of the beam 28 and the at least one temperature-responsive electrical component 36 responds primarily to the temperature of the cooking plate 12. This enables simplified electronic control apparatus 20 to be employed.

The close proximity of the temperature sensor assembly 26 to the cooking plate 12 results in increased distance between the at least one heating element 14 and the temperature sensor assembly 26 and this, coupled with the optional feature of a reflective layer on the underside of the beam 28, reduces the influence of direct radiation from the at least one heating element 14 on the temperature-responsive electrical component or components 36 of the temperature sensor assembly 26.

Figure 9:
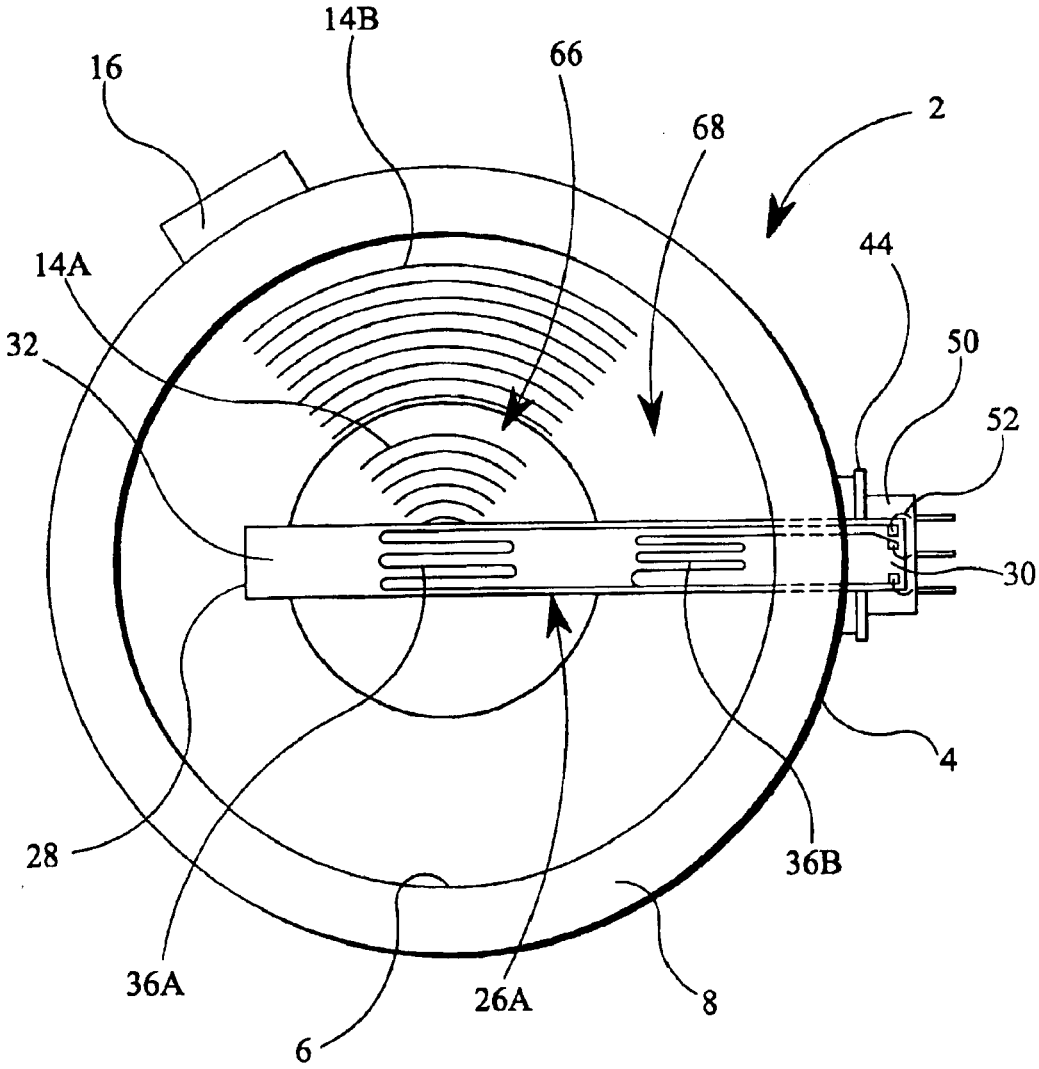
FIG. 9 is a plan view of a radiant electric heater forming part of the present invention having dual heating zones and provided with a temperature sensor assembly.

Referring now to FIG. 9, a radiant electric heater 2 is constructed in similar manner to the heater of FIGS. 1 and 2 with the exception that multiple heating zones are provided. As shown, two heating zones 66 and 68 are provided, although more than two could be considered. The heating zones 66, 68 are concentrically arranged and each is provided with at least one heating element 14A, 14B. The heating zone 66 is arranged to be energised alone or together with the heating zone 68.

A temperature sensor assembly 26A is provided, substantially as previously described for the temperature sensor assembly 26, with the exception that two separate temperature-responsive electrical components 36A and 36B of film or foil form are provided on the upper surface 32 of the beam 28. The component 36A monitors the temperature of a region of the cooking plate above the heating zone 66 and the component 36B monitors the temperature of a region of the cooking plate above the heating zone 68.

A change in differential temperature between the cooking zones 66, 68 can be monitored to detect the size of a cooking vessel (such as the cooking vessel 24 shown in FIG. 2) located on the cooking plate over the heater. If the temperature of the cooking plate above the outer heating zone 68 increases relative to that above the inner heating zone 66, this would indicate that a small cooking vessel has been placed over the inner heating zone 66, but with both heating zones 66, 68 energised. If both heating zones 66, 68 are detected as becoming excessively hot, this would indicate both zones 66, 68 being energised under free-radiation conditions, that is without a cooking vessel being present.

If the temperature of the cooking plate above the inner zone 66 is detected as being high relative to that above the outer zone 68, this could indicate that a cooking vessel having a bowed base has been placed on the cooking plate.

FIG. 10 illustrates an embodiment of electronic control apparatus 20 for use in the present invention. The apparatus 20 is arranged to receive input signals from the at least one temperature-responsive component 36 of film or foil form of the temperature sensor assembly 26 and also input signals from the manual control switch device 22. The input signals from the temperature sensor assembly 26 are processed by a fail-safe circuit 70 having a fixed threshold for temperature, and such that the at least one heating element 14 is arranged to be de-energised by operation of a main switch 72, such as a relay, at a temperature above such fixed threshold for temperature.

The input signals from the manual control switch device 22, and the input signals from the temperature sensor assembly 26 are processed by a signal processing circuit 74, of analog or digital form, which is interfaced with a solid-state control switch 76, such as a triac, for controlling energising of the at least one heating element 14. The signal processing circuit 74 is arranged to compare temperature sensed by the sensor assembly 26 with position of the manual control switch device 22 and energise or de-energise the at least one heating element 14, depending upon whether the sensed temperature is respectively below or above that set by the manual control switch device 22.

When the processing circuit 74 is a digital circuit, it suitably consists of a microprocessor interfaced with the temperature sensor assembly 26 by way of an analog to digital converter, and also interfaced with the manual control switch device 22 by way of a digital output driver.

When the processing circuit 74 is an analog circuit, it suitably comprises an integrated circuit adapted for analog signal processing, which compares input signals from the manual control switch device 22 with input signals from the temperature sensor assembly 26 and controls energising of the at least one heating element 14 in a manner proportional to the difference between the two input signals. Such control of energising of the at least one heating element 14 is effected by way of an output signal tailored to specific control requirements of the solid-state switch 76.

Control of the at least one heating element 14 is thus able to be effected in a manner which is known as closed-loop control.

What is claimed is:

1. A cooking apparatus comprising a radiant electric heater (2) and electronic control apparatus (20), the heater being arranged for location underneath and against a cooking plate (12) and incorporating a heating element (14) spaced from the cooking plate and a temperature sensor assembly (26), wherein the temperature sensor assembly comprises a beam (28) of ceramic material provided within the heater (2) and extending at least partially across the heater over the heating element (14), the beam having a substantially planar upper surface (32) arranged to face the cooking plate (12) and an under surface (34) arranged for exposure to direct radiation from the heating element, the planar upper surface having provided thereon an electrical component (36) having an electrical parameter which changes as a function of temperature of the cooking plate, the electrical component (36) being electrically connected by means of electrical leads (54) to the electronic control apparatus (20), which electronic control apparatus receives input signals from at least one electrical component (36) on the upper surface of the beam (28) and also input signals from a manual control switch device (22), the input signals from the at least one electrical component being processed by a fail-safe circuit (70) having a fixed threshold temperature such that at least one heating element (14) is arranged to be de-energised at a temperature above such fixed threshold.

2. An apparatus as claimed in claim 1, wherein the temperature sensor assembly (26) is located in a central region of the heater (2).

3. An apparatus as claimed in claim 1, wherein the temperature sensor assembly (26) is secured at least at one end region thereof to the heater (2) at a periphery of the heater.

4. An apparatus as claimed in claim 3, wherein at least one end region of the beam (28) extends outside the heater (2).

5. An apparatus as claimed in claim 4, wherein the beam (28) is secured, at one end region thereof, to the heater (2) by means of a bracket (44) which securely receives the one end region of the beam and is fixed to an external region of the heater.

6. An apparatus as claimed in claim 5, wherein the bracket (44) is selected from metal, ceramic and plastics.

7. An apparatus as claimed in claim 3, wherein the beam (28) is secured, at one end region thereof, to the heater (2) by securely passing through an aperture (56) in a peripheral wall (8) of the heater.

8. An apparatus as claimed in claim 1, wherein the peripheral wall (8) comprises a substantially rigid material.

9. An apparatus as claimed in claim 8, wherein the peripheral wall (8) comprises bound vermiculite.

10. An apparatus as claimed in claim 3, wherein a terminal block (50) is provided in a position selected from at, and adjacent to, one end region of the beam (28).

11. An apparatus as claimed in claim 1, wherein the beam (28) is supported with spring biasing (58) towards the cooking plate (12).

12. An apparatus as claimed in claim 1, wherein the input signals from the manual control switch device (22), and the input signals from the at least one electrical component (36), are processed by a signal processing circuit (74) of a form selected from analog and digital form which is in terfaced with a switch means (76) for controlling energising of the at least one heating element (14).

13. A apparatus as claimed in claim 12, wherein the signal processing circuit (74) is arranged to compare sensed temperature with position of the manual control switch device (22) and carry out a function selected from energising and de-energising the at least one heating element (14), depending upon whether the sensed temperature is respectively at a temperature selected from below and above that set by the manual control switch device.

14. An apparatus as claimed in claim 12, wherein the signal processing circuit (74) is a digital circuit, comprising a microprocessor interfaced with the at least one electrical component (36) by way of an analog to digital converter and interfaced with the manual control switch device (22) by way of a digital output driver.

15. An apparatus as claimed in claim 12, wherein the signal processing circuit (74) is an analog circuit comprising an analog signal processing integrated circuit which compares input signals from the manual control switch device (22) with input signals from the at least one electrical component (36) and controls energising of the at least one heating element (14) in a manner proportional to the difference between the two input signals.

16. An apparatus as claimed in claim 15, wherein the control of energising of the at least one heating element (14) is effected by way of an output signal tailored to specific control requirements of a solid state switch device (76) which operates to control energising of the at least one heating element.

17. An apparatus as claimed in claim 1, wherein control of the at least one heating element (14) is effected in closed loop manner.

18. An apparatus as claimed in claim 1, wherein the upper surface (32) of the beam (28) is arranged to be in contact with the cooking plate (12).

19. An apparatus as claimed in claim 1, wherein the upper surface (32) of the beam (28) is arranged to be in close proximity to the cooking plate (12).

20. An apparatus as claimed in claim 19, wherein the substantially planar upper surface (32) of the beam (28) is arranged to face the cooking plate (12) at a distance of substantially not more than 3.5 mm therefrom.

21. An apparatus as claimed in claim 20, wherein the substantially planar upper surface (32) of the beam (28) is arranged to face the cooking plate (12) at a distance of from 0.5 to 3.5 mm therefrom.

22. An apparatus as claimed in claim 21, wherein the substantially planar upper surface (32) of the beam (28) is arranged to face the cooking plate (12) at a distance of from 0.5 to 2.0 mm therefrom.

23. An apparatus as claimed in claim 1, wherein the electrical component (36) having an electrical parameter which changes as a function of temperature is selected from film and foil form.

24. An apparatus as claimed in claim 23, wherein the electrical component (36) has electrical conductors selected from film and foil form extending therefrom to one end region of the beam (28).

25. An apparatus as claimed in claim 23, wherein the electrical component (36) comprises an electrical resistance component whose electrical resistance changes as a function of temperature.

26. An apparatus as claimed in claim 25, wherein the electrical resistance component comprises platinum.

27. An apparatus as claimed in claim 23, wherein the electrical component (36) is of thick film form.

28. An apparatus as claimed in claim 1, wherein a protective layer (42) is provided over the electrical component (36).

29. An apparatus as claimed in claim 28, wherein the protective layer (42) is selected from glass and ceramic.

30. An apparatus as claimed in claim 1, wherein a layer of thermal radiation reflective material is provided on the under surface (34) of the beam (28).

31. An apparatus as claimed in claim 1, wherein the beam (28) is structurally reinforced.

32. An apparatus as claimed in claim 31, wherein the beam (28) has a shape selected from a T-shaped and H-shaped cross section.

33. An apparatus as claimed in claim 1, wherein the material of the beam (28) is selected from steatite, alumina and cordierite.

34. An apparatus as claimed in claim 1, wherein a plurality of heating zones (66, 68), each with a heating element (14A, 14B), are provided substantially side-by-side in the heater (2), a corresponding plurality of the electrical components (36A, 36B) being provided on the substantially planar upper surface (32) of the beam (28), each of the electrical components being located in a corresponding heating zone, whereby temperature of the cooking plate (12) is able to be monitored.

35. An apparatus as claimed in claim 34, wherein the plurality of heating zones (66, 68) are provided in concentric arrangement.

36. An apparatus as claimed in claim 34, wherein means (20) is provided to determine the difference in temperature between the plurality of heating zones (66, 68) in cooperation with the plurality of electrical components (36A, 36B) and used to determine features selected from placement and position of a cooking vessel (24) on the cooking plate (12) and size of a cooking vessel on the cooking plate and/or curvature of a base of a cooking vessel on the cooking plate.

* * * * *